US010038961B2

(12) United States Patent
Ma et al.

(10) Patent No.: US 10,038,961 B2
(45) Date of Patent: Jul. 31, 2018

(54) MODELING A FREQUENCY RESPONSE CHARACTERISTIC OF AN ELECTRO-ACOUSTIC TRANSDUCER

(71) Applicant: DOLBY LABORATORIES LICENSING CORPORATION, San Francisco, CA (US)

(72) Inventors: Guilin Ma, Beijing (CN); Xiguang Zheng, Beijing (CN); C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/316,099

(22) PCT Filed: Jun. 2, 2015

(86) PCT No.: PCT/US2015/033771
§ 371 (c)(1),
(2) Date: Dec. 2, 2016

(87) PCT Pub. No.: WO2015/191335
PCT Pub. Date: Dec. 17, 2015

(65) Prior Publication Data

US 2017/0099554 A1 Apr. 6, 2017

Related U.S. Application Data

(60) Provisional application No. 62/019,718, filed on Jul. 1, 2014.

(30) Foreign Application Priority Data

Jun. 9, 2014 (CN) ..... 2014 1 0275430

(51) Int. Cl.
*H04R 29/00* (2006.01)
*H04R 1/10* (2006.01)

(52) U.S. Cl.
CPC ..... *H04R 29/001* (2013.01); *H04R 1/1091* (2013.01)

(58) Field of Classification Search
USPC ..... 381/26, 58, 59, 60, 303, 309, 370, 98, 381/358
See application file for complete search history.

(56) References Cited

U.S. PATENT DOCUMENTS 8,050,425 B2 11/2011 Iwamatsu
8,160,282 B2 4/2012 Christoph
(Continued)

FOREIGN PATENT DOCUMENTS

CN 103237287 8/2013
EP 2453669 5/2012
(Continued)

OTHER PUBLICATIONS

Bodden, Markus "Binaural Modeling and Auditory Scene Analysis" IEEE Workshop on Applications of Signal Processing to Audio and Acoustics, Mohonk Mountain House, New Paltz, NY, pp. 31-34, Oct. 1995.

(Continued)

*Primary Examiner* — Yosef K Laekemariam

(57) ABSTRACT

Example embodiments disclosed herein relate to modelling a frequency response characteristic of an electro-acoustic transducer. A method includes obtaining at least one measurement of the frequency response characteristic for at least one electro-acoustic transducer of the category. A model of a frequency response characteristic specific to a category of electro-acoustic transducers is generated at least in part based on perceptual importance of a frequency band, an averaged, normalized or microphone compensated measurement such that the distortion of the model is optimized. A further method for estimating a frequency response characteristic of an electro-acoustic transducer is based on the (Continued)

generated model and the sensitivity of the electro-acoustic transducer or headphone. Corresponding system and computer program product are also disclosed.

12 Claims, 4 Drawing Sheets

(56) References Cited

U.S. PATENT DOCUMENTS

| | | | | |
|---|---|---|---|---|
| 8,325,931 | B2 | 12/2012 | Howard | |
| 8,472,653 | B2 | 6/2013 | Kon | |
| 2004/0218771 | A1 | 11/2004 | Chalupper | |
| 2006/0093159 | A1* | 5/2006 | Koh | H04R 3/04 381/98 |
| 2007/0078546 | A1 | 4/2007 | Hsieh | |
| 2009/0095804 | A1 | 4/2009 | Agevik | |
| 2010/0111315 | A1 | 5/2010 | Kroman | |
| 2010/0178934 | A1* | 7/2010 | Moeglein | G01S 5/0263 455/456.1 |
| 2010/0322428 | A1 | 12/2010 | Fukui | |
| 2011/0002471 | A1 | 1/2011 | Wihardja | |
| 2012/0014527 | A1 | 1/2012 | Furse | |
| 2013/0156213 | A1 | 6/2013 | Pan | |

FOREIGN PATENT DOCUMENTS

| | | |
|---|---|---|
| WO | 2010/014663 | 2/2010 |
| WO | 2013/042968 | 7/2013 |
| WO | 2013/124490 | 8/2013 |

OTHER PUBLICATIONS

Borwick, John "Loudspeaker and Headphone Handbook" Third Edition, Jan. 1, 2001, pp. 91-98, 164, 199,416,529, 536-548,552-560, 585-692.

Feistel, S. et al "Modelling of Loudspeaker Systems Using High-Resolution Data" AESq presented at the 121st Convention, Oct. 5-8, 2006, San Francisco, USA, pp. 1-25.

Dalbjorn, K. et al "Automatic Verification of Large Sound Reinforcement Systems Using Models of Loudspeaker Performance Data" AES presented at the 125th Convention, Oct. 2-5, 2008, San Francisco, CA USA, pp. 1-8.

Ease Speaker Lab v1.1.12, http://soundsum.com/service/srv_updt4.php.

* cited by examiner

MODELING A FREQUENCY RESPONSE CHARACTERISTIC OF AN ELECTRO-ACOUSTIC TRANSDUCER

CROSS-REFERENCE TO RELATED APPLICATIONS

This application claims priority to Chinese Patent Application No. 201410275430.4, filed Jun. 9, 2014 and U.S. Provisional Patent Application No. 62/019,718, filed Jul. 1, 2014, each of which is hereby incorporated by reference in its entirety.

TECHNOLOGY

Embodiments of the present application generally relate to signal processing, and more specifically, to modeling a frequency response characteristic of an electro-acoustic transducer.

BACKGROUND

A frequency response characteristic of an electro-acoustic transducer needs to be known in some applications using audio enhancement techniques, such as binaural rendering and noise compensation (or cancellation). As used herein, an electro-acoustic transducer may comprise, for example, a headphone, a microphone, a speaker, and any other device which may transform electrical signals to acoustic signals. Furthermore, the frequency response characteristic may include, for example, a headphone to eardrum transfer function, a microphone to eardrum transfer function, a transmission loss of a headphone, a transmission loss of a microphone and the like.

In the application of noise compensation, for example, an appropriate gain for an audio signal played by a headphone is calculated to compensate an environmental noise signal in an ambient environment external to the audio signal. It should be noted that in the application of noise compensation, in order to calculate the gain, the frequency response characteristics of the headphone and a microphone associated with the headphone are usually measured to estimate the perceived audio and environmental noise signals. As used herein, a microphone associated with a headphone refers to a microphone, which may be inserted into or located near a headphone, which may record an environmental noise signal which may influence the perception of an audio signal played by the headphone. The measurement is often performed by an acoustic engineer using a professional measurement device. However, this approach may be costly and time consuming.

SUMMARY

In order to address the foregoing and other potential problems, the example embodiments disclosed herein proposes a method and system for modeling a frequency response characteristic of an electro-acoustic transducer.

In a first aspect, example embodiments disclosed herein provide a method for generating a model of a frequency response characteristic specific to a category of electro-acoustic transducers. The method includes obtaining at least one measurement of the frequency response characteristic for at least one electro-acoustic transducer of the category and generating the model based on the at least one measurement. Embodiments in this regard further comprise a corresponding computer program product.

In a second aspect, example embodiments disclosed herein provide a system for generating a model of a frequency response characteristic specific to a category of electro-acoustic transducers. The system includes a measurement obtaining unit configured to obtain at least one measurement of the frequency response characteristic for at least one electro-acoustic transducer of the category and a model generating unit configured to generate the model based on the at least one measurement.

In a third aspect, example embodiments disclosed herein provide a method for estimating a frequency response characteristic of an electro-acoustic transducer. The method includes determining a category of the electro-acoustic transducer; retrieving a model of the frequency response characteristic specific to the category and estimating the frequency response characteristic of the electro-acoustic transducer at least in part based on the model. The model is generated according to the first aspect of the example embodiments disclosed herein. Embodiments in this regard further include a corresponding computer program product.

In a fourth aspect, example embodiments disclosed herein provide a system for estimating a frequency response characteristic of an electro-acoustic transducer. The system includes a determining unit configured to determine a category of the electro-acoustic transducer, a retrieving unit configured to retrieve a model of the frequency response characteristic specific to the category and an estimating unit configured to estimate the frequency response characteristic of the electro-acoustic transducer at least in part based on the model. The model is generated according to the first aspect of the example embodiments disclosed herein.

Through the following description, it would be appreciated that according to the example embodiments disclosed herein, a model of a frequency response characteristic specific to a category of electro-acoustic transducers may be generated based on at least one measurement of the frequency response characteristic for at least one electro-acoustic transducer of the category, and then a frequency response characteristic of an arbitrarily selected electro-acoustic transducer of the category may be estimated based on the model. In this way, there is no need for performing a measurement of a frequency response characteristic on every individual electro-acoustic transducer, and therefore the cost and time may be saved.

Other advantages achieved by the example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
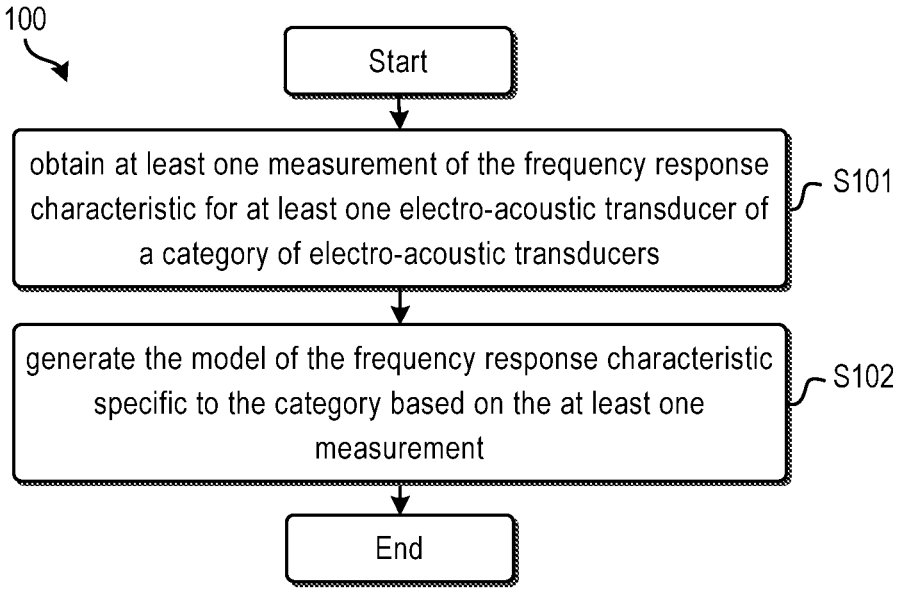
FIG. 1 illustrates a flowchart of a method for generating a model of a frequency response characteristic specific to a category of electro-acoustic transducers according to some example embodiments disclosed herein.

Principles of the example embodiments disclosed herein will now be described with reference to various example embodiments illustrated in the drawings. It should be appreciated that depiction of these embodiments is only to enable those skilled in the art to better understand and further implement the example embodiments disclosed herein, not intended for limiting the scope of the example embodiments disclosed herein in any manner.

As described above, an example approach for obtaining a frequency response characteristic of an electro-acoustic transducer is that an acoustic engineer may use a professional measurement device to measure the frequency response characteristic of the electro-acoustic transducer. Such an approach may be costly and time consuming, because a measurement may need to be performed on every individual electro-acoustic transducer.

In order to address the above and other potential problems, some example embodiments disclosed herein propose a method and system for generating a model of a frequency response characteristic specific to a category of electro-acoustic transducers. In the method and system, the common characteristics of similar electro-acoustic transducers are considered. According to example embodiments disclosed herein, electro-acoustic transducers may be categorized into a plurality of categories based on their acoustic characteristics, wherein each category of electro-acoustic transducers has similar acoustic characteristics. Then, a model of the frequency response characteristic specific to a category of electro-acoustic transducers may be generated. In this way, there is no need for performing a measurement of a frequency response characteristic on every individual electro-acoustic transducer, and therefore the cost and time may be saved.

Now reference is made to FIG. 1 which illustrates a flowchart of a method 100 for generating a model of a frequency response characteristic specific to a category of electro-acoustic transducers according to some example embodiments disclosed herein.

As illustrated in FIG. 1, at step S101 of the method 100, at least one measurement of the frequency response characteristic is obtained for at least one electro-acoustic transducer of a category of electro-acoustic transducers.

As described above, according to example embodiments disclosed herein, electro-acoustic transducers may be categorized into several categories based on their acoustic characteristics. Since a category of electro-acoustic transducers may have similar acoustic characteristics, the category of electro-acoustic transducers may have similar frequency response characteristics. For example, when a headphone is taken as an example of an electro-acoustic transducer, the categories of headphones may include over the ear headphones, ear buds, ear inserts, and the like.

In an embodiment of the example embodiments disclosed herein, the number of the categories may vary with different applications. For example, the number of the categories may be more if the application requires a more accurate model of the frequency response characteristic specific to a category of electro-acoustic transducers, and vice versa.

According to the example embodiments disclosed herein, for a category, the frequency response characteristics of at least one electro-acoustic transducer may be measured, for example, by an acoustic engineer using a professional measurement device. In an embodiment, the at least one electro-acoustic transducer may include one electro-acoustic transducer, if the electro-acoustic transducer may be sufficiently representative of the category. In another embodiment, the at least one electro-acoustic transducer may include a plurality of electro-acoustic transducers in order to improve the accuracy of the generated model of the frequency response characteristic specific to the category.

The method 100 then proceeds to step S102, where the model of the frequency response characteristic specific to a category of electro-acoustic transducers is generated based on the at least one measurement of the frequency response characteristic obtained for the at least one electro-acoustic transducer of the category. As a result, a frequency response characteristic specific to a category of electro-acoustic transducers may be modeled based on the common characteristics of the category of electro-acoustic transducers.

With the method 100, a frequency response characteristic may be modeled for a category of electro-acoustic transducers, and therefore there is no need for performing a measurement of a frequency response characteristic on every individual electro-acoustic transducer. In this way, the cost and time may be saved.

In some example embodiments disclosed herein, the generation of a model of a frequency response characteristic specific to a category of electro-acoustic transducers at step S102 of the method 100 may be performed based on the averaging of the at least one measurement of the frequency response characteristic obtained for the at least one electro-acoustic transducers of the category.

In an embodiment, the average value of the at least one measurement may be taken as the model. As discussed above, the at least one measurement may include one or more measurements. If one measurement is obtained, the average value may be the measurement itself.

Alternatively, in another embodiment, if more than one measurement is obtained, the average value of the maximum and minimum of the measurements may be taken as the model. By the averaging approach, the common frequency spectrum shape of the at least one measurement of the frequency response characteristic may be derived substantially, and the complexity may be low.

The averaging approach may be suitable for the applications with larger error tolerance. In order to further improve the accuracy of the model of the frequency response characteristic specific to a category of electro-acoustic transducers, in an embodiment of the example embodiments disclosed herein, the model may be further generated at least in part based on the perceptual importance of a frequency band. For example, since the contributions of different frequency bands to the perception of an audio signal may be different, more weight may be assigned for a more important frequency band during the averaging process.

Now, returning to step S102 of the method 100, in some other example embodiments disclosed herein, the generation of a model of a frequency response characteristic specific to a category of electro-acoustic transducers may be performed such that the distortion of the model with respect to the at least one measurement may be optimized.

In the embodiments, an optimized model may be derived based on a certain optimization target, which may employ some distortion calculation criteria. For example, the optimization target may be directed to ensure that an under-estimation error and an over-estimation error between the model and the at least one measurement are minimized. As used herein, the under-estimation error refers to an error due to the model being smaller than the at least one measurement, and an over-estimation error refers to an error due to the model being larger than the at least one measurement.

With the optimization approach, the accuracy of the model of the frequency response characteristic specific to a category of electro-acoustic transducers may be improved. Similar to the averaging approach as described above, in an embodiment of the example embodiments disclosed herein, during the optimization process, the model may be generated at least in part based on the perceptual importance of a frequency band in order to further improve the accuracy of the model. For example, more weight may be assigned for a more important frequency band.

Alternatively or additionally, in another embodiment of the example embodiments disclosed herein, in order to further improve the accuracy of the model during the optimization process, the at least one measurement of the frequency response characteristic for the at least one electro-acoustic transducer may be normalized, and then the model may be generated based on the normalized measurement. By the normalization process, the sensitivity difference between electro-acoustic transducers may be eliminated, and therefore a common frequency spectrum shape of the at least one measurement of the frequency response may be derived more accurately.

Specifically, in an embodiment, it is assumed that there are N measurements of the frequency response characteristic for a category of electro-acoustic transducers. If $f_{h,n}$ represents the frequency response characteristic n of a electro-acoustic transducer h, a broadband normalization offset $e_{h,n}$ for $f_{h,n}$ may be given by:

$$e_{h,n} = \frac{1}{K}\left(\sum_{k=1}^{K} \alpha_n(k) \cdot f_{h,n}(k) - \sum_{k=1}^{K} \alpha_n(k) \cdot f_{mean,n}(k)\right) \tag{1}$$

where $k(1 \le k \le K)$ represents a frequency band index, K represents the total number of frequency bands, $\alpha_n(k)$ represents the importance weight for frequency band k, and $$f_{mean,n}(k) = \underset{h}{\text{mean}}(f_{h,n}(k)).$$

The normalized $f_{h,n}$ (denoted $\overline{f_{h,n}}$) is given by:

$$\overline{f_{h,n}} = f_{h,n} - e_{h,n} \tag{2}$$

It should be noted the normalization algorithm as discussed above is just for the purpose of illustration, without limiting the scope of the example embodiments disclosed herein.

Figure 2:
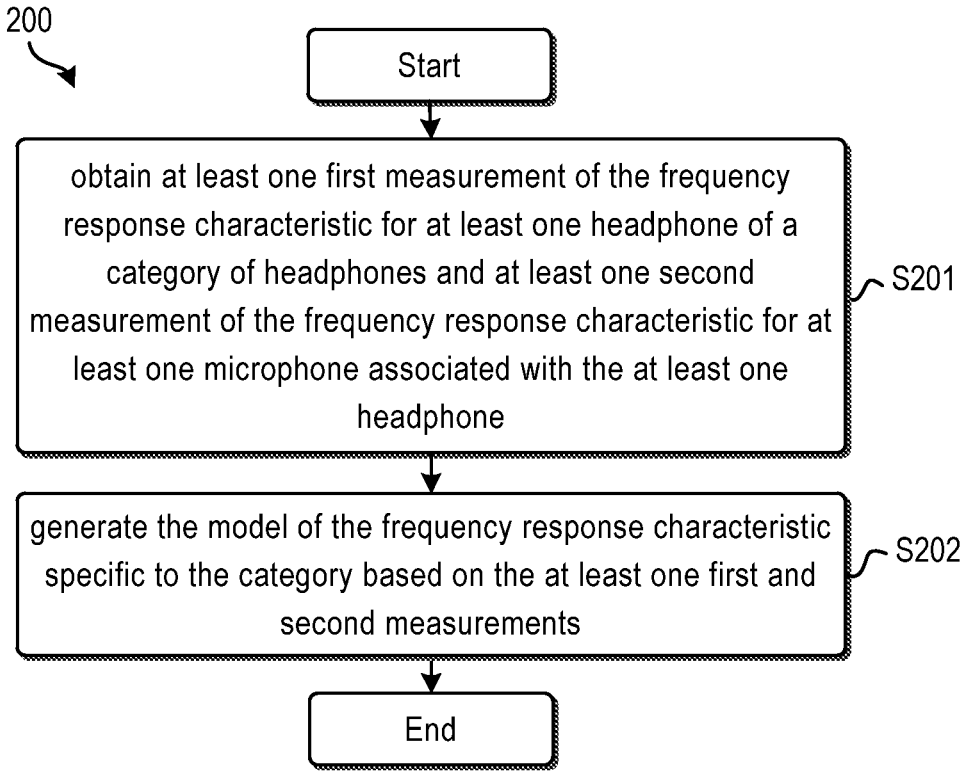
FIG. 2 illustrates a flowchart of a method for generating a model of a frequency response characteristic specific to a category of electro-acoustic transducers according to some other example embodiments disclosed herein.

FIG. 2 illustrates a flowchart of a method 200 for generating a model of a frequency response characteristic specific to a category of electro-acoustic transducers according to some other example embodiments disclosed herein, wherein a headphone is taken as an example of an electro-acoustic transducer.

As described above, in the application of noise compensation, the frequency response characteristics of a headphone and an associated microphone may be jointly affecting the gain to be applied to the audio signal played by the headphone in order to compensate the environmental noise signal in an ambient environment external to the audio signal. For example, if the frequency response of the headphone is increased, the gain will be decrease, and vice versa; if the frequency response of the associated microphone is increased, the gain will be increased; and vice versa.

As a result, in this application, the frequency response characteristics of a headphone and an associated microphone may be both needed. The method 200 as illustrated in FIG. 2 may be suitable for such an application.

At step S201 of the method 200, as illustrated in FIG. 2, at least one first measurement of the frequency response characteristic for at least one headphone of a category of headphones and at least one second measurement of the frequency response characteristic for at least one microphone associated with the at least one headphone are obtained.

As describe above with respect to FIG. 1, based on the acoustic characteristics of headphones, the headphones may be categorized into several categories including, for example, over the ear headphones, ear buds, ear inserts, and the like. Likewise, the number of the categories may vary with different applications.

In an embodiment of the example embodiments disclosed herein, for a category of headphones, the frequency response characteristics of at least one headphone may be measured. Additionally, the frequency response characteristics of at least one microphone associated with the at least one headphone may be measured. As described above, the measurement may also be performed, for example, by an acoustic engineer using a professional measurement device.

The method 200 then proceeds to step S202, where the model of the frequency response characteristic specific to a category of headphones is generated based on the at least one first measurement of the frequency response characteristic for the at least one headphone and the at least one second measurement of the frequency response characteristic for the at least one associated microphone.

With the method 200, a model of a frequency response characteristic specific to a category of headphones may be generated jointly based on the frequency response characteristic of the associated microphones, and therefore the accuracy of the model may be ensured.

Likewise, as described with respect to FIG. 1, an optimization approach may be employed. Additionally, the perceptual importance of a frequency band may be considered. Alternatively or additionally, the normalization of at least one first measurement of the frequency response characteristic of at least one headphone and at least one second measurement of the frequency response characteristic of at least one associated microphone may be employed.

Specifically, in an embodiment, the optimization criteria may comprise finding pairs of $f_{opt,HETF}(k)$ and $f_{opt,METF}(k)$ to minimize:

$$\max_h \|(\eta(k) \cdot f_{opt,HETF}(k) - \mu(k) \cdot f_{opt,METF}(k)) - (\eta(k) \cdot \overline{f_{h,HETF}}(k) - \mu(k) \cdot \overline{f_{h,METF}}(k))\|$$

-continued where $$\min_h(\overline{f_{h,HETF}}(k)) \le f_{opt,HETF}(k) \le \max_h(\overline{f_{h,HETF}}(k))$$

$$\min_h(\overline{f_{h,HETF}}(k)) \le f_{opt,METF}(k) \le \max_h(\overline{f_{h,HETF}}(k))$$

$$\overline{f_{h,HETF}} = f_{h,HETF} - e_{h,HETF}$$

$$\overline{f_{h,METF}} = f_{h,METF} - e_{h,METF}$$

$\eta(k)$ represents the importance weight of the HETF for a frequency band k $\mu(k)$ represents the importance weight of the METF for a frequency band k and where the HETF represents the frequency response characteristic of a headphone, the METF represents the frequency response characteristic of a microphone associated with the headphone, $f_{h,HETF}$ represents the frequency response characteristic of a headphone h, $f_{h,METF}$ represents the frequency response characteristic of the microphone associated with a headphone h, $e_{h,HETF}$ represents a broadband normalization offset for $f_{h,HETF}$, and $e_{h,METF}$ represents a broadband normalization offset for $f_{h,METF}$.

And then the optimization criteria may comprise, among the selected pairs of $f_{opt,HETF}(k)$ and $f_{opt,METF}(k)$ finding a pair of $f_{opt,HETF}(k)$ and $f_{opt,METF}(k)$ to minimize:

$$\eta(k)\cdot\left\|f_{opt,HETF}(k) - 0.5\cdot\left(\max_h(\overline{f_{h,HETF}}(k)) - \min_h(\overline{f_{h,HETF}}(k))\right)\right\| + \mu(k)\cdot\left\|\overline{f_{h,METF}}(k) - 0.5\cdot\left(\max_h(\overline{f_{h,METF}}(k)) - \min_h(\overline{f_{h,METF}}(k))\right)\right\|$$

In an embodiment of the example embodiments disclosed herein, if the generation of the model is based on the linear combination of the at least one measurement of the frequency response characteristic, the optimization target is directed to find a set of frequency response characteristics $f_{opt,n}$ to, for each frequency band, minimize:

$$\max_h\left\|\sum_{n=1}^{N}\beta_n(k)\cdot f_{opt,n}(k) - \sum_{n=1}^{N}\beta_n(k)\cdot\overline{f_{h,n}}(k)\right\|$$

where $\beta_n(k)$ represents the importance weight of the $n^{th}$ frequency response characteristic for a frequency band k.

It should be noted that the approach of the combination of the at least one measurement of the frequency response characteristic may not be linear. It should also be noted the optimization criteria as discussed above is just for the purpose of illustration, and any other optimization criteria may be used to perform the joint optimization. Thus, the scope of the example embodiments disclosed herein should not be limited in this regard.

Figure 3:
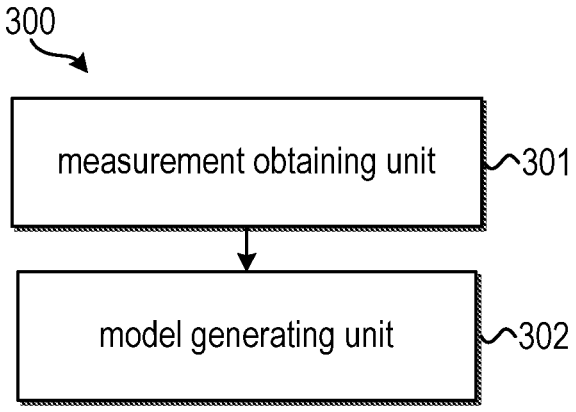
FIG. 3 illustrates a block diagram of a system for generating a model of a frequency response characteristic specific to a category of electro-acoustic transducers according to some example embodiments disclosed herein.

FIG. 3 illustrates a block diagram of a system 300 for generating a model of a frequency response characteristic specific to a category of electro-acoustic transducers according to some example embodiments disclosed herein.

As illustrated in FIG. 3, the system 300 may comprise a measurement obtaining unit 301 and a model generating unit 302. The measurement obtaining unit 301 may be configured to obtain at least one measurement of the frequency response characteristic for at least one electro-acoustic transducer of the category. The model generating unit 302 may be configured to generate the model based on the at least one measurement.

In some example embodiments disclosed herein, the model generating unit 302 may be further configured to generate the model at least in part based on perceptual importance of a frequency band.

Alternatively or additionally, in some example embodiments disclosed herein, the model generating unit 302 may be further configured to generate the model such that the distortion of the model with respect to the at least one measurement is optimized.

In some example embodiments disclosed herein, the system 300 may further comprise a normalizing unit configured to normalize the at least one measurement. In the embodiments, the model generating unit 302 may be configured to generate the model based on the normalized measurement.

In some example embodiments disclosed herein, the electro-acoustic transducer may be a headphone. In the embodiments, the measurement obtaining unit 301 may be further configured to obtain at least one first measurement of the frequency response characteristic for at least one headphone of a category of headphones and at least one second measurement of the frequency response characteristic for at least one microphone associated with the at least one headphone. The model generating unit 302 may be further configured to generate the model of the frequency response characteristic specific to the category based on the at least one first and second measurements.

In some example embodiments disclosed herein, the system 300 may further comprise an averaging unit configured to average the at least one measurement. The model generating unit 302 may be further configured to generate the model based on the averaged measurement.

For the sake of clarity, some optional components of the system 300 are not illustrated in FIG. 3. However, it should be appreciated that the features as described above with reference to FIGS. 1 and 2 are all applicable to the system 300. Moreover, the components of the system 300 may be a hardware module or a software unit module. For example, in some example embodiments disclosed herein, the system 300 may be implemented partially or completely with software and/or firmware, for example, implemented as a computer program product embodied in a computer readable medium. Alternatively or additionally, the system 300 may be implemented partially or completely based on hardware, for example, as an integrated circuit (IC), an application-specific integrated circuit (ASIC), a system on chip (SOC), a field programmable gate array (FPGA), and so forth. The scope of the example embodiments disclosed herein is not limited in this regard.

As described with respect to FIGS. 1-3, according to some example embodiments disclosed herein, a model of a frequency response characteristic specific to a category of electro-acoustic transducers may be generated based on at least one measurement of the frequency response characteristic for at least one electro-acoustic transducer of the category. Once the model is generated, a frequency response characteristic of an arbitrarily selected electro-acoustic transducer of the category may be estimated based on the model. Thus, there is no need for performing a measurement of a frequency response characteristic on every individual electro-acoustic transducer.

Figure 4:
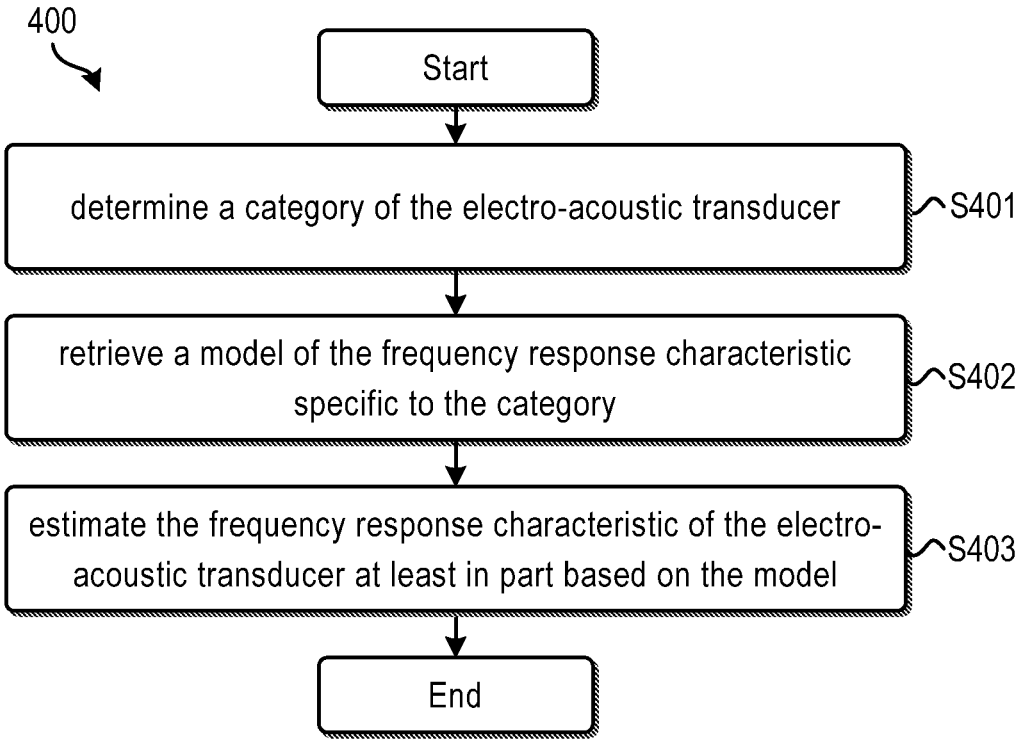
FIG. 4 illustrates a flowchart of a method for estimating a frequency response characteristic of an electro-acoustic transducer according to some example embodiments disclosed herein.

FIG. 4 illustrates a flowchart of a method 400 for enhancing the intelligibility of speech content in an audio signal according to some example embodiments disclosed herein.

As illustrated in FIG. 4, in the method 400, at step S401, a category of the electro-acoustic transducer is determined.

In an embodiment of the example embodiments disclosed herein, the category of the electro-acoustic transducer may be determined based on information on the category inputted by a user. For example, the user may input the name of the selected electro-acoustic transducer and then its category may be retrieved in a pre-defined table. Alternatively, the user may take a picture of the selected electro-acoustic transducer and then its category may be determined based on the picture.

After the category of the electro-acoustic transducer is determined, the method 400 proceeds to step S402, where a model of the frequency response characteristic specific to the category is retrieved.

In the example embodiments disclosed herein, the model may be generated according to the methods 100 and 200 as described above with respect to FIGS. 1 and 2.

Then, at step S403 of the method 400, the frequency response characteristic of the electro-acoustic transducer may be estimated at least in part based on the model.

With the method 400, the frequency response characteristic of an arbitrarily selected electro-acoustic transducer may be estimated based on the model of the frequency response characteristic specific to the category of the selected electro-acoustic transducer, and thereby the frequency response characteristic of an arbitrarily selected electro-acoustic transducer may be easily obtained.

In an embodiment of the example embodiments disclosed herein, the retrieved model may be employed as the estimated frequency response characteristic of the selected electro-acoustic transducer.

Alternatively, in another embodiment of the example embodiments disclosed herein, the frequency response characteristic of the selected electro-acoustic transducer may be estimated based on the model and the sensitivity of the electro-acoustic transducer. In this way, during the estimation process, a sensitivity of the electro-acoustic transducer may be taken into account such that the accuracy of the estimate may be improved.

According to example embodiments disclosed herein, the model of the frequency response characteristic specific to a category of electro-acoustic transducers may correspond to the combination of sensitivities of at least one sample electro-acoustic transducer of the category. Thus, there may be an offset between the sensitivity of the selected electro-acoustic transducer and the combination of the sensitivities. Such an offset may reflect moving-up or moving-down of the estimated frequency response of the selected electro-acoustic transducer with respect to the model of the frequency response characteristic specific to the category.

In an embodiment, the offset of sensitivity may be determined such that the estimated frequency response characteristic of the selected electro-acoustic transducer may be calibrated based on the offset.

In an example approach of determining the offset, the frequency response characteristic of a representative electro-acoustic transducer of the category of the selected electro-acoustic transducer may be known in advance. Then, by using the same stimuli, the difference between the sensitivity of the representative electro-acoustic transducer and the sensitivity of the selected electro-acoustic transducer may be obtained.

Alternatively, in another example approach of determining the offset, the offset may be determined based on user input. For example, after the estimated frequency response characteristic of the selected electro-acoustic transducer is obtained, a user may input information indicating a perceptual sensitivity of the estimated electro-acoustic transducer.

As described above, some example embodiments disclosed herein may be applied to the application of noise compensation, where the frequency response characteristics of a headphone may be modeled based on the frequency response characteristic of a microphone associated with the headphone. In this application, the frequency response characteristic of the headphone may be estimated based on the model of the frequency response characteristic specific to the category of the headphone and the first sensitivity of the headphone and the second sensitivity of a microphone associated with the headphone.

Figure 5:
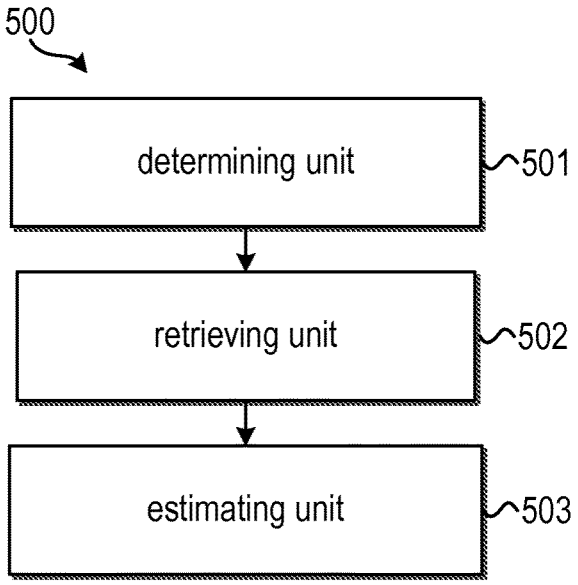
FIG. 5 illustrates a block diagram of a system for estimating a frequency response characteristic of an electro-acoustic transducer according to some example embodiments disclosed herein.

FIG. 5 illustrates a block diagram of a system 500 for estimating a frequency response characteristic of an electro-acoustic transducer according to some example embodiments disclosed herein.

As illustrated in FIG. 5, the system 500 comprises a determining unit 501, a retrieving unit 502 and an estimating unit 503. The determining unit 501 may be configured to determine a category of the electro-acoustic transducer. The retrieving unit 502 may be configured to retrieve a model of the frequency response characteristic specific to the category. The estimating unit 503 may be configured to estimate the frequency response characteristic of the electro-acoustic transducer at least in part based on the model. In the example embodiments disclosed herein, the model may be generated according to the methods 100 and 200 as described above with respect to FIGS. 1 and 2.

In some example embodiments disclosed herein, the estimating unit 503 may be configured to estimate the frequency response characteristic of the electro-acoustic transducer based on the model and the sensitivity of the electro-acoustic transducer.

In some example embodiments disclosed herein, the electro-acoustic transducer may be a headphone. In the embodiments, the estimating unit 503 may be configured to estimate the frequency response characteristic of the headphone based on the model of the frequency response characteristic specific to the category of the headphone and the first sensitivity of the headphone and the second sensitivity of a microphone associated with the headphone.

For the sake of clarity, some optional components of the system 500 are not illustrated in FIG. 5. However, it should be appreciated that the features as described above with reference to FIG. 4 are all applicable to the system 500. Moreover, the components of the system 500 may be a hardware module or a software unit module. For example, in some example embodiments disclosed herein, the system 500 may be implemented partially or completely with software and/or firmware, for example, implemented as a computer program product embodied in a computer readable medium. Alternatively or additionally, the system 500 may be implemented partially or completely based on hardware, for example, as an integrated circuit (IC), an application-specific integrated circuit (ASIC), a system on chip (SOC), a field programmable gate array (FPGA), and so forth. The scope of the example embodiments disclosed herein is not limited in this regard.

Figure 6:
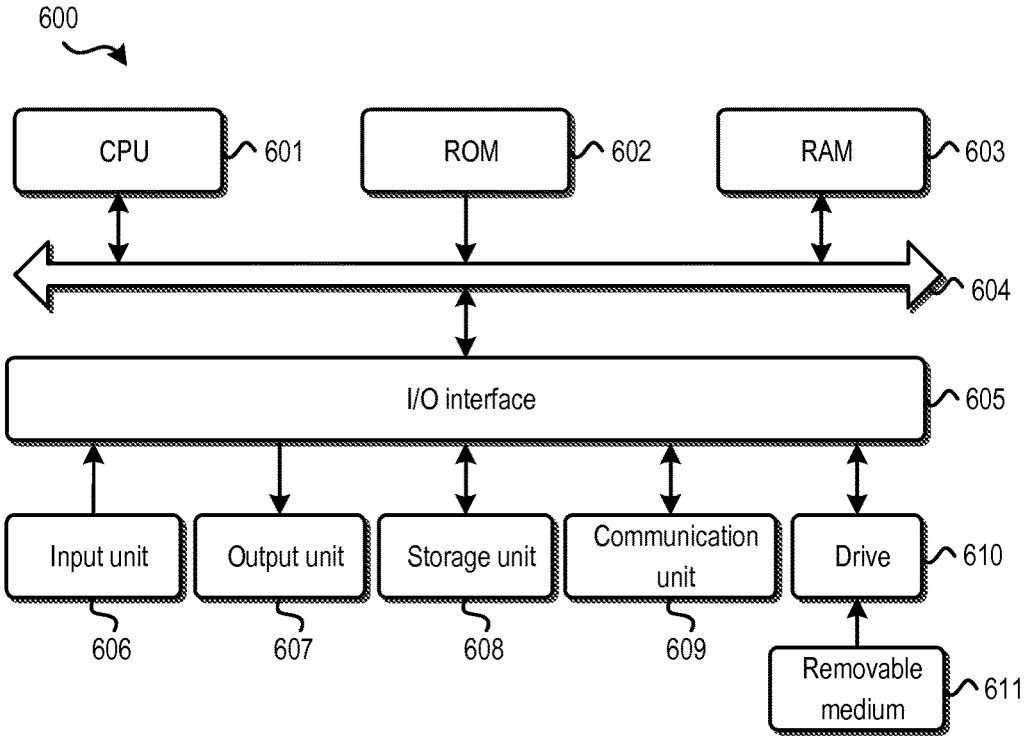
FIG. 6 illustrates a block diagram of an example computer system suitable for implementing example embodiments disclosed herein.

FIG. 6 illustrates a block diagram of an example computer system 600 suitable for implementing example embodiments disclosed herein. As illustrated, the computer system 600 comprises a central processing unit (CPU) 601 which is capable of performing various processes according to a program stored in a read only memory (ROM) 602 or a program loaded from a storage section 608 to a random access memory (RAM) 603. In the RAM 603, data required when the CPU 601 performs the various processes or the like is also stored as required. The CPU 601, the ROM 602 and the RAM 603 are connected to one another via a bus 604. An input/output (I/O) interface 605 is also connected to the bus 604.

The following components are connected to the I/O interface 1005: an input section 606 including a keyboard, a mouse, or the like; an output section 607 including a display such as a cathode ray tube (CRT), a liquid crystal display (LCD), or the like, and a loudspeaker or the like; the storage section 608 including a hard disk or the like; and a communication section 605 including a network interface card such as a LAN card, a modem, or the like. The communication section 605 performs a communication process via the network such as the internet. A drive 610 is also connected to the I/O interface 605 as required. A removable medium 611, such as a magnetic disk, an optical disk, a magneto-optical disk, a semiconductor memory, or the like, is mounted on the drive 610 as required, so that a computer program read therefrom is installed into the storage section 608 as required.

Specifically, according to example embodiments disclosed herein, the processes described above with reference to FIGS. 1, 2 and 4 may be implemented as computer software programs. For example, example embodiments disclosed herein comprise a computer program product including a computer program tangibly embodied on a machine readable medium, the computer program including program code for performing methods 100, 200 and/or 400. In such embodiments, the computer program may be downloaded and mounted from the network via the communication section 605, and/or installed from the removable medium 611.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks illustrated in the flowcharts may be viewed as method steps, and/or as operations that result from operation of computer program code, and/or as a plurality of coupled logic circuit elements constructed to carry out the associated function(s). For example, example embodiments disclosed herein include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the example embodiments disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order illustrated or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any example embodiment or of what may be claimed, but rather as descriptions of features that may be specific to particular embodiments of particular example embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination.

Various modifications, adaptations to the foregoing example embodiments of this example embodiment may become apparent to those skilled in the relevant arts in view of the foregoing description, when read in conjunction with the accompanying drawings. Any and all modifications will still fall within the scope of the non-limiting and example embodiments of this example embodiment. Furthermore, other embodiments of the example embodiments set forth herein will come to mind to one skilled in the art to which these embodiments of the example embodiment pertain having the benefit of the teachings presented in the foregoing descriptions and the drawings.

It will be appreciated that the embodiments of the example embodiment are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method for generating a model of a frequency response characteristic specific to a category of electro-acoustic transducers, wherein each electro-acoustic transducer in a category of electro-acoustic transducers has similar acoustic characteristics, wherein the electro-acoustic transducer is a headphone, the method comprising:

obtaining at least one first measurement of the frequency response characteristic for at least one headphone of the category of headphones and at least one second measurement of the frequency response characteristic for at least one microphone connected to the at least one headphone; and generating the model of the frequency response characteristic specific to the category based on the at least one first and second measurements, wherein generating the model comprises one of:

calculating an average value of the at least one first and second measurements;

calculating an average value of a minimum value among the at least one first and second measurements, and a maximum value among the at least one first and second measurements;

calculating an optimized value based on an optimization process to minimize an under-estimation error and an over-estimation error between the optimized value and the at least one first and second measurement, wherein the under-estimation error refers to an error due to the optimized value being smaller than the at least one first and second measurements, and the over-estimation error refers to an error due to the optimized value being larger than the at least one measurement.

2. The method according to claim 1, wherein the model comprises calculating an optimized value, wherein the model is further generated at least in part based on perceptual importance of a frequency band.

3. The method according to claim 1, wherein the model comprises calculating an optimized value, wherein the method further comprises normalizing the at least one measurement, and wherein generating the model comprises generating the model based on the normalized measurement.

4. A method for estimating a frequency response characteristic of an electro-acoustic transducer, wherein the electro-acoustic transducer is a headphone, the method comprising:

determining a category of the electro-acoustic transducer based on acoustic characteristics of the electro-acoustic transducer;

retrieving a model of the frequency response characteristic specific to the category; and estimating the frequency response characteristic of the electro-acoustic transducer at least in part based on the model, wherein the model is generated according to claim 1.

5. The method according to claim 4, wherein estimating the frequency response characteristic of the electro-acoustic transducer comprises:

estimating the frequency response characteristic of the headphone based on the model of the frequency response characteristic specific to the category of the headphone and the first sensitivity of the headphone and the second sensitivity of a microphone connected to the headphone.

6. A system for generating a model of a frequency response characteristic specific to a category of electro-acoustic transducers, wherein each electro-acoustic transducer in a category of electro-acoustic transducers has similar acoustic characteristics, wherein the electro-acoustic transducer is a headphone, the system comprising:

a measurement obtaining unit configured to obtain at least one first measurement of the frequency response characteristic for at least one headphone of the category of headphones and at least one second measurement of the frequency response characteristic for at least one microphone connected to the at least one headphone; and a model generating unit configured to generate the model of the frequency response characteristic specific to the category based on the at least one first and second measurements, wherein generating the model comprises one of:

calculating an average value of the at least one first and second measurements;

calculating an average value of a minimum value among the at least one first and second measurements, and a maximum value among the at least one first and second measurements;

calculating an optimized value based on an optimization process to minimize an under-estimation error and an over-estimation error between the optimized value and the at least one first and second measurement, wherein the under-estimation error refers to an error due to the optimized value being smaller than the at least one first and second measurements, and the over-estimation error refers to an error due to the optimized value being larger than the at least one measurement.

7. The system according to claim 6, wherein the model comprises calculating an optimized value, wherein the model generating unit is further configured to generate the model at least in part based on perceptual importance of a frequency band.

8. The system according to claim 6, wherein the model comprises calculating an optimized value, wherein the system further comprises a normalizing unit configured to normalize the at least one measurement, and wherein the model generating unit is configured to generate the model based on the normalized measurement.

9. A system for estimating a frequency response characteristic of an electro-acoustic transducer, wherein the electro-acoustic transducer is a headphone, the system comprising:

a determining unit configured to determine a category of the electro-acoustic transducer based on acoustic characteristics of the electro-acoustic transducer;

a retrieving unit configured to retrieve a model of the frequency response characteristic specific to the category; and an estimating unit configured to estimate the frequency response characteristic of the electro-acoustic transducer at least in part based on the model, wherein the model is generated according to claim 1.

10. The system according to claim 9, wherein the estimating unit is configured to estimate the frequency response characteristic of the headphone based on the model of the frequency response characteristic specific to the category of the headphone and the first sensitivity of the headphone and the second sensitivity of a microphone connected to the headphone.

11. A non-transitory computer-readable medium with instructions stored thereon that when executed by one or more processors for generating a model of a frequency response characteristic specific to a category of electro-acoustic transducers, wherein each electro-acoustic transducer in a category of electro-acoustic transducers has similar acoustic characteristics, wherein the electro-acoustic transducer is a headphone, the computer program product being tangibly stored on a non-transient computer-readable medium and comprising machine executable instructions which, when executed, cause the machine to perform steps of the method according to claim 1.

12. A non-transitory computer-readable medium with instructions stored thereon that when executed by one or more processors for estimating a frequency response characteristic of an electro-acoustic transducer, wherein the electro-acoustic transducer is a headphone, the computer program product being tangibly stored on a non-transient computer-readable medium and comprising machine executable instructions which, when executed, cause the machine to perform steps of the method according to claim 4.

* * * * *